United States Patent [19]

Nicoll

[11] Patent Number: 4,955,488

[45] Date of Patent: Sep. 11, 1990

[54] CLUSTER BIN SYSTEM

[76] Inventor: James D. Nicoll, 829 Randall, Troy, Mich. 48098

[21] Appl. No.: 341,839

[22] Filed: Apr. 24, 1989

[51] Int. Cl.[5] ..... A47F 5/00

[52] U.S. Cl. ..... 211/88; 211/55; 211/128

[58] Field of Search ..... 211/182, 183, 88, 103, 211/55, 128

[56] References Cited

U.S. PATENT DOCUMENTS

| | | | |
|---|---|---|---|
| 2,105,594 | 1/1938 | Henrich | 211/88 X |
| 2,119,788 | 6/1938 | Kieffer et al. | 211/128 X |
| 2,356,473 | 8/1944 | Saul, Jr. | 211/128 X |
| 3,511,386 | 5/1970 | Greenberger | 211/88 |
| 4,099,813 | 7/1978 | Olivan | 211/55 X |
| 4,162,014 | 7/1979 | Bobrick | 211/55 X |
| 4,493,425 | 1/1985 | Yoshida | 211/182 X |
| 4,588,094 | 5/1986 | Evans | 211/55 |
| 4,706,820 | 11/1987 | Spamer et al. | 211/183 X |

*Primary Examiner*—David L. Talbott
*Assistant Examiner*—Daniel Hulseberg
*Attorney, Agent, or Firm*—Krass & Young

[57] ABSTRACT

A cluster bin assembly includes a generally planar member which may be folded into a bin-shaped configuration and mounted upon a wall. The member includes hook-like portions which cooperate with wall brackets to retain the folded bin therein. The particular configuration of the bin results in support of the base of the bin by the wall thus providing for a rigidly supported floor in the bin without the need for additional fastening.

12 Claims, 2 Drawing Sheets

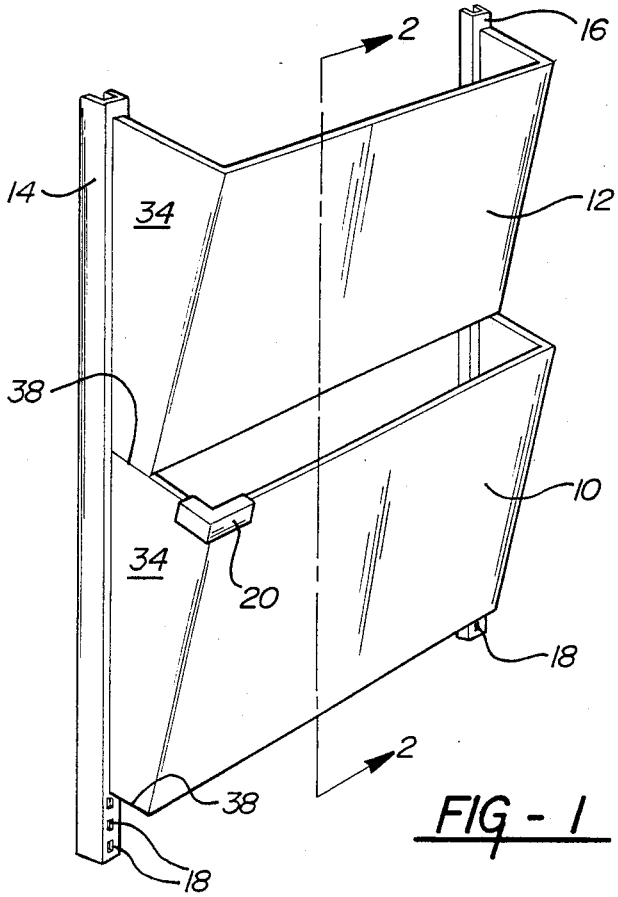
FIG - 1
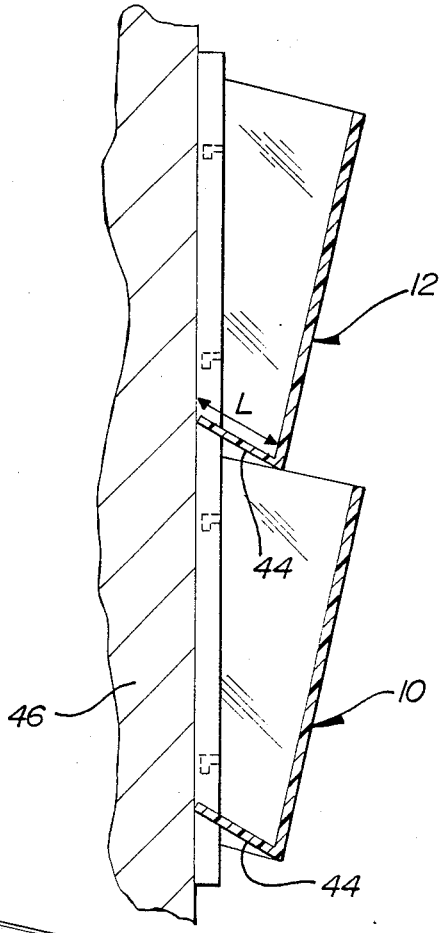
FIG - 2
FIG - 1A
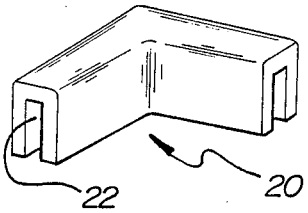
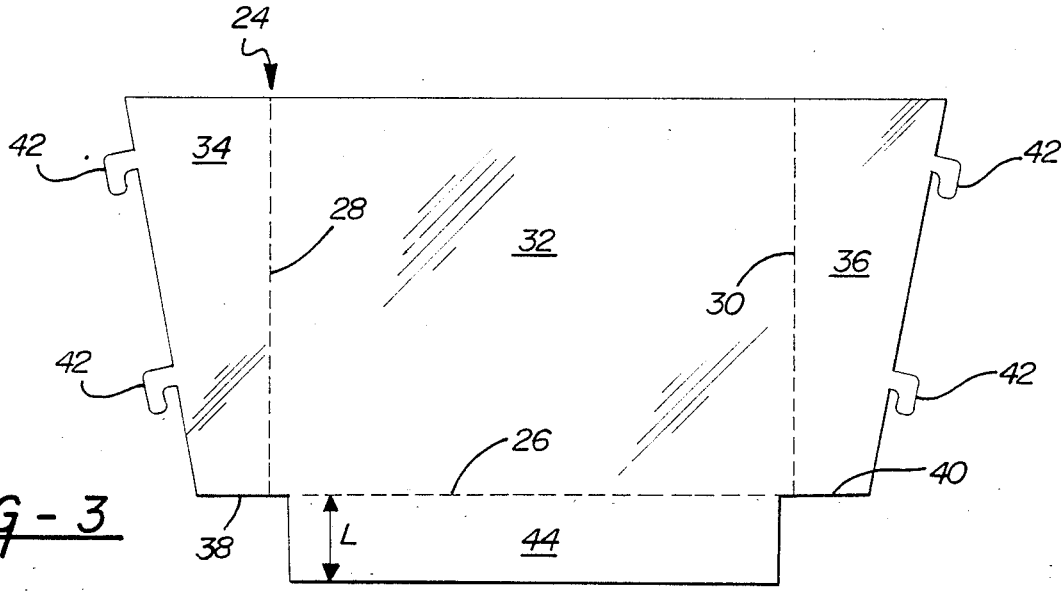
FIG - 3

CLUSTER BIN SYSTEM

FIELD OF THE INVENTION

This invention relates generally to storage systems and more particularly to vertically mounted storage systems. Specifically, the present invention relates to storage systems comprised of a plurality of generally planar members which may be folded into bins and retainably attached to a wall.

BACKGROUND OF THE INVENTION

Since time immemorial, problems of storing and organizing items have plagued mankind. Evidence has been found that early humanoids utilized naturally occurring holes, niches and ledges for storage of a variety of objects. Owing to the ever-increasing world population and the concomitant increase in the number of manufactured items, storage space has become a very significant concern.

In any building, particularly a commercial building, floor space is at a premium because it represents an expenditure of money. Anything that consumes large amounts of floor space relative to the revenue it generates represents a business loss. In businesses such as advertising agencies, architectural firms, engineering firms and the like, large amounts of flat work are generated. This flat work, often of unusual and diverse sizes, may occupy space in an office for time periods ranging from days to years. Storage of such materials consumes inordinate amounts of otherwise productive floor space. Usually, flat work is set in inefficient piles or stood on edge against walls until needed. Such storage represents lost space that could be more productively utilized and furthermore can result in damage or loss of stored articles.

What is needed is a storage system capable of accommodating a variety of oversized or odd-shaped items in a manner which will remove them from the floor but yet leave them readily accessible for retrieval. Conventional shelving retains items upon a generally horizontal surface and is thus not well suited for storing large flat items. Various prior art approaches to wall mounted storage of flat items have been implemented; however, such methods have not fully addressed storage problems, particularly problems associated with the storage of oversized or odd-shaped items.

Henrich U.S. Pat. No. 2,105,594 discloses a unitary, multi-compartmented, card rack fabricated from a single sheet of metal. The rack of Henrich is configured to be appropriately bent and to be nailed to a wall. By folding the appropriate interlocking tabs, the metal sheet may be configured to provide a plurality of compartments. The rack of Henrich is not a modular item and hence the spacing and number of the associated compartments cannot be varied. Furthermore, the compartments of Henrich do not include a full bottom and cannot be utilized to store loose items such as pencils, small machine parts and the like.

Bobrick U.S. Pat. No. 4,162,014 discloses a wall-mounted vertical file configured to hold business correspondence and the like. The file of Bobrick includes a primary tray which is affixed to the wall by nailing and a plurality of secondary trays supported by the primary tray. A similar arrangement is disclosed in Evans U.S. Pat. No. 4,588,094. Holders of this type are suited for light business correspondence, however they cannot adequately support relatively large art work, drawings and the like insofar as the entirety of the assembly is supported by the primary tray. Additionally, support arrangements of this type do not provide any flexibility in spacing and arrangement of the individual compartments.

Howitt U.S. Pat. No. 4,051,789 and Thomson U.S. Pat. No. 3,247,809 disclose shelving units which attach to wall tracks. Units of this type do not provide for vertical storage and as noted hereinabove are not suited for storage of large flat items.

What is needed is a storage system which may be adapted to provide for the vertical storage of a variety of items, particularly large flat items. It is further desirable that such storage systems allow for ready positioning and repositioning of the storage units. It is further desirable that such a system be low cost and easy to use. The present invention provides for a wall-mounted storage system referred to a "cluster bin system." This system includes a number of wall-mounted storage bins which may be utilized singly or in various combinations. The bins are of relatively low cost and may be stored in a flat, unassembled form until needed. They are light in weight and may be made in relatively large sizes for storage of oversized items. The bins are sturdy and provide a positive bottom seal enabling them to hold small loose items without loss. The cluster bins of the present invention provide for a storage system which is easy to use, low in cost and readily adaptable for a variety of applications. These and other advantages of the present invention will be readily apparent from the drawings, discussion, description and claims which follow.

BRIEF DESCRIPTION OF THE INVENTION

There is disclosed herein a cluster bin system which includes a unitary, planar member configured to be folded into a bin and attached to a wall. The planar member includes three generally linear, living hinges disposed so as to divide the planar member into four regions. The first region has a length defined by the length of the second and third hinges and a base width defined by the separation of the second and third hinges proximate the first hinge. The first region is configured to form the front surface of the bin when the planar member is folded along the hinges. The second and third hinges are separated from the first region by the second and third hinges respectively and are approximate mirror images of one another. Each of the second and third regions have a base which is generally linearly aligned with the first hinge and these regions are configured to form the sides of the bin when the planar member is folded along the hinges. The second and third regions also have attachment means associated therewith for fastening the bin to the wall. The planar member further includes a fourth region separated from the first region by the first hinge. The fourth region has a width which is no greater than the base width of the first region and it has a length which is greater than the length of each of the bases of the first and second region. The base is retained by the wall when the bin is fastened thereto.

The cluster bin system of the present invention may further include a plurality of track members each configured to be attached to the wall and each including a plurality of slots therein. In this embodiment, the attachment means associated with the second and third regions include at least one hook configured to be retainably received in one of the slots on the track members. The bin members are preferably fabricated from a material selected from the group consisting essentially of: synthetic polymeric materials, metals, cardboard and combinations thereof.

The bins may be fabricated in various shapes and may be preferably fabricated to attach to a wall in a nesting or piggyback relationship. The living hinges may be provided by embossed regions formed in the body of material from which the bin member is fabricated.

BRIEF DESCRIPTION OF THE DRAWINGS

FIG. 1 is a perspective view of one embodiment of cluster bin assembly of the present invention shown as mounted in use;

FIG. 1A is an enlarged, perspective view of a corner reinforcing member as illustrated with reference to the embodiment of FIG. 1;

FIG. 2 is a cross-sectional view of the bins of FIG. 1 as taken along line 2—2;

FIG. 3 is a top plan view of one of the bins of FIG. 1 as shown in its unfolded form;

DETAILED DESCRIPTION OF THE INVENTION

Figure 4:
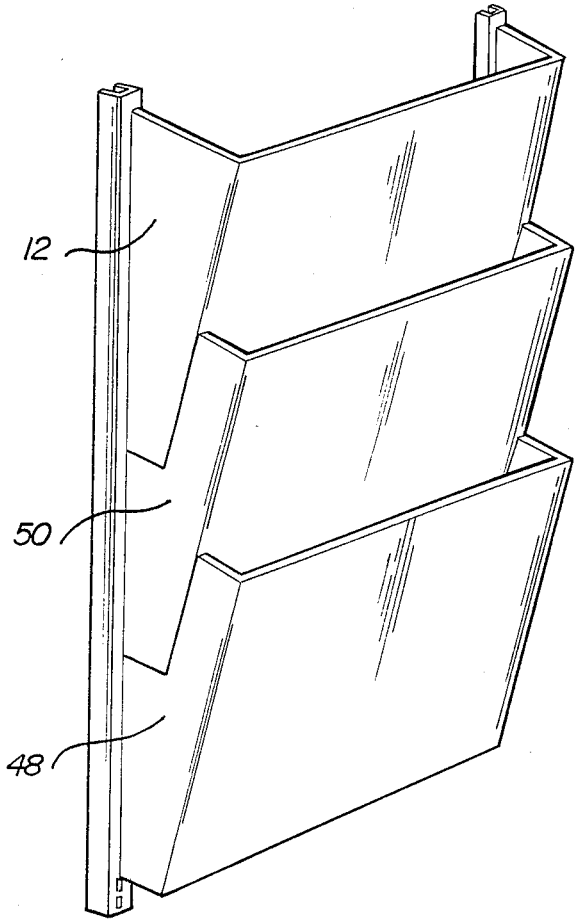
FIG. 4 is a perspective view of another embodiment of the present invention illustrating the concept of nesting bins.

Referring now to FIG. 1, there is shown one embodiment of the present invention wherein a pair of bins 10,12 are mounted on a pair of tracks 14,16 which in turn are affixed to a wall. The tracks 14,16 in this embodiment are configured as elongated members including a plurality of spaced apart vertical slots 18 therein. Tracks of this type are well known and widely utilized in the mounting of book shelves and other similar items onto walls.

The bins 10,12, as will be explained in greater detail hereinbelow, may, be fabricated from a relatively lightweight, durable material such as polyethylene, polypropylene, nylon, or other such synthetic polymeric materials as well as thin metal, cardboard and various combinations of the foregoing. The bins 10,12 may be made of any arbitrary size as dictated by storage needs; however, it is anticipated that the width of the bins will correspond to a multiple of standard wall stud spacing so as to facilitate secure wall mounting. For example, it is a construction standard that wall studs be spaced 16 inches apart Therefore, the bins 10,12 may be most advantageously fabricated in 16 and 32 inch widths. Although two bins are illustrated in FIG. 1, it will be appreciated that additional bins may be similarly added by merely extending the length of the track members 14,16 and securing additional bins thereto.

In some instances it will be desirable to increase the dimensional stability of the bins, particularly when they are relatively wide or when relatively heavy items will be placed therein. Toward that end, various reinforcing devices may be employed in combination with the bins. FIG. 1 illustrates one such reinforcement member 20 as employed in conjunction with bin 10. This member is illustrated in greater detail with reference to FIG. 1A. As shown therein, the reinforcement member 20 is a generally L-shaped channel member configured to fit about one corner of the bin. The channel 22 engages the edges of the bin and the reinforcement member 20 prevents the corner of the bin from flexing. This member may be advantageously fabricated from a rigid plastic, metal or similar durable material. Obviously, other fasteners such as corner braces may be similarly employed.

Referring now to FIG. 3, there is shown a top plan view of a bin 24 generally similar to those of FIG. 1 as disposed in a flattened form. The bin 24 of FIG. 3 will be seen to be a planar member including a plurality of living hinges therein. As utilized herein, the term "living hinge" is meant to define a hinge formed in and integral with, a relatively resilient material by rendering a portion of the material more flexible as for example by perforations, tempering, embossing or forming a thinner region therein. Hinges of this type are well known to those of skill in the art and are utilized in a variety of applications. Typically, living hinges are formed in sheets of polymeric materials such as polypropylene, polyethylene, nylon or various reinforced composites.

As illustrated in FIG. 3, the planar bin member 24 includes three living hinges 26,28 and 30. These hinges generally divide the planar member into four regions. The first region 32 is bounded by all three hinges. The second and third hinges 28,30 define the length of the first region 32, and the separation between the second and third hinges 28,30 most proximate the first hinge 26 defines the base width of the first region 32. It is to be noted that in the illustrated embodiment, the base width of the first region 32 is slightly greater than the length of the first living hinge 26 and the reason for this particular construction will be explained in greater detail hereinbelow.

The planar bin member 24 further includes a second region 34 and a third region 36 which are approximate mirror images of one another. The second and third regions 34 and 36 are separated from the first region 32, by the second 28 and third 30 hinges respectively. The second 34 and third 36 regions each include a base 38 and 40 respectively, which is aligned linearly with the first hinge 26. The second 34 and third 36 regions also include means for attaching the bin to the wall and in the illustrated embodiment, such means comprise a plurality of hooks 42 integral with the second 34 and third 36 members. These hooks are configured to engage slots in wall tracks generally similar to those illustrated at 14 and 16 in FIG. 1. It is to be appreciated that other attachment means such as loops or tabs adapted to receive screws or nails may be similarly employed.

The planar bin member 24 further includes a fourth region 44 separated from the first region by the first hinge 26. It is notable that the fourth region 44 has a width which is no greater than the base width of the first region 32 and a length L which is greater than the length of the bases 38,40 of the second 34 and third 36 regions.

The planar bin member 24 of FIG. 3 may be readily folded to form a bin mountable upon a wall and having a bottom supported thereby. In order to form the bin, the second 34, third 36, and fourth 44 regions are folded in the same general direction and at approximate right angles to the plane of the first region 32. In this manner, the first region 32 forms the front surface of the bin, the second and third regions 34 and 36 form the sides of the bin and the fourth region 44 forms the base of the bin. As is noted hereinabove, the width of the fourth region 44 is to be no greater than the base width of the first region 32, to allow for clearance of the side walls by the fourth region 44 when it is folded into the base position. Preferably, and as is illustrated in FIG. 3, the fourth region 44 is slightly narrower than the base width. So as to allow the base of the bin to clear the tracks when the bin is mounted. Alternatively, the corners of the fourth region may be notched to provide the requisite clearance. It is also notable that the length L of the fourth region 44 is greater than the length of the bases 38,40 of the third 34 and fourth 36 regions. By so configuring the fourth member, the base of the bin is retainably supported by the wall upon which the member is affixed as is best illustrated with reference to FIG. 2.

FIG. 2 is a cross-sectional view of the bins of FIG. 1 taken along line 2—2 and illustrates the two bins 10 of FIG. 1 as supported on the wall 46. Since the spacing of the base of the bin from the supporting wall will be determined by the length of the bases 38,40 of the third 34 and fourth 36 regions; and since, the length L of the fourth member 44 is greater than the distance from the wall, the fourth region 44 will be supported against the wall in an upward position as illustrated in FIG. 2. In this manner, the fourth region 44 will cooperate with the wall 46 to provide a stable base for the bin.

Numerous variations of the aforementioned embodiment will be readily apparent in light of the foregoing description. For example, the individual bins of the present invention may be configured to nest in a piggyback relationship as is illustrated with reference to FIG. 4. By appropriately notching the second and third regions of the planar bin member, bins may be made to nest in a more compact form. FIG. 4 illustrates two such bins 48,50 in a nesting relationship. Also shown in FIG. 4 is a bin 12 generally similar to that previously described shown nested with a piggyback style bin 50.

Figure 5:
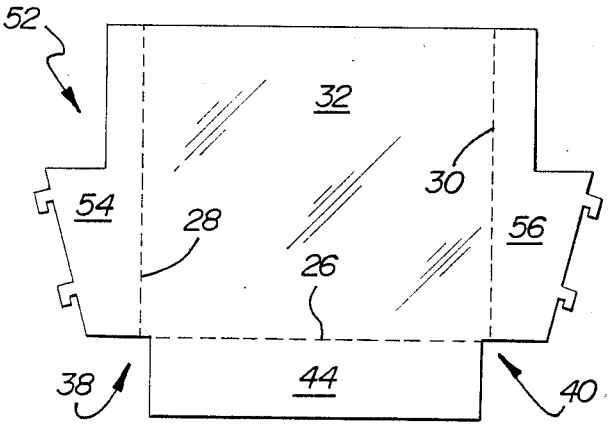
FIG. 5 is a top plan view of one of the nesting bins of FIG. 4 as shown in its unfolded form.

Referring now to FIG. 5 there is shown an unfolded, planar form 52 of a piggyback style bin. This bin includes three living hinges 26,28,30 as previously described and defining a first, second and third region. The first region 32 is generally similar to that previously described as is the fourth region 44. The second and third regions 54,56 differ from second and third regions described hereinabove, by the inclusion of a notched portion distal the base 38 and 40 thereof respectively.

Figure 6:
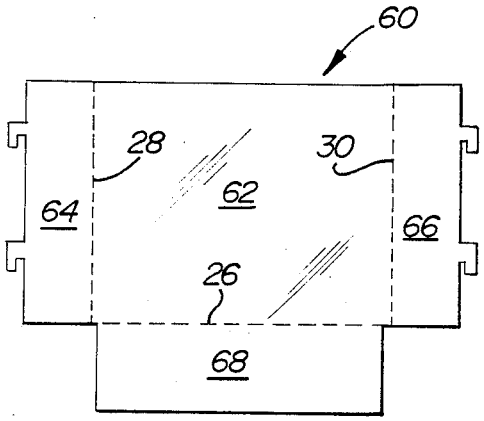
FIG. 6 is a top plan view of another design of bin as shown in its unfolded form.

Other configurations may be similarly adapted. For example, FIG. 6 illustrates yet another planar bin member 60 including three living hinges 26,28,30 defining four regions 62,64,66,68 which are all rectangular parallelograms. This planar bin 60, when folded, will provide a cubicle style bin.

Figure 7:
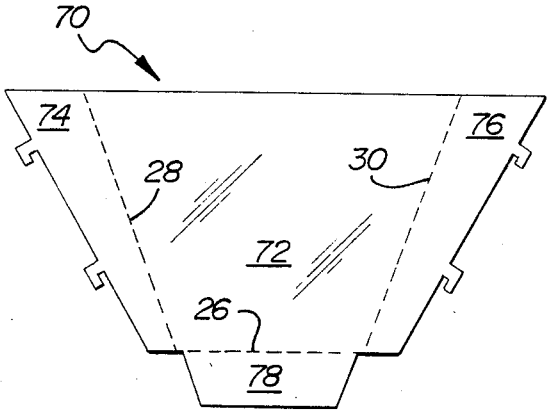
FIG. 7, is a top plan view of yet another configuration of bin as shown in its unfolded form.

FIG. 7 illustrates yet another embodiment of planar bin member 70 wherein three hinges 26,28,30 define four generally trapezoidal regions 72,74,76,78. When folded and wall-mounted, the member 70 provides a generally tapered bin. It will obviously be appreciated that there are still further embodiments which may be structured in accord with the principles disclosed herein. For example, the fourth region 78 of the planar member 70 of FIG. 7 may be configured as a rectangular member. In yet other embodiments, still further regions may be defined to provide a covered bin. Likewise, cut-out regions may be included in various portions of the bin to provide for decreased weight or improved visibility of items stored therein.

In light of the foregoing, it will be appreciated that many variations of the present invention may be made in accord with the principles and teachings disclosed herein and for this reason, the foregoing drawings, discussion, description and explanation are merely meant to be illustrative of particular embodiments of the present invention are not meant to be limitations upon the practice thereof. It is the following claims, including all equivalents, which define the scope of the invention.

I claim:

1. A cluster bin system including a unitary, planar member configured to be folded into a bin and attached to a wall, said planar member including a first, a second, and a third generally linear, hinge disposed so as to divide the planar member into fur regions;

said first region having a length defined by said second and third hinges and a base width defined by the separation of the second and third hinges proximate the first hinge, said first region configured to form the front surface of the bin when the planar member is folded along the hinges;

said second and third regions being separated from the first region by the second and third hinges respectively, said second and third regions being approximate mirror images of one another and having a base which is generally linearly aligned with the first hinge, said second and third regions configured to form the sides of the bin when the planar member is folded along the hinges, said second and third regions each having attachment means associated therewith for fastening the bin to the wall; and said fourth region being separated from the first region by the first hinge and having a width which is no greater than the base width of the first region and a length which is greater than the length of the base of the second and third regions, said fourth region configured to form the bottom of the bin when the planar member is folded along the hinges and attached to the wall by said attachment means associated with the second and third regions, said bottom being planar and having a length greater than the distance from the first hinge to the wall, whereby said planar bottom is retained and supported by the wall without attachment thereto, and further wherein no means for connection is provided between the fourth region and the second or third regions.

2. A cluster bin system as in claim 1 further including a plurality of track members each configured to be attached to the wall and including a plurality of slots therein; and wherein, the attachment means associated with the second and third regions comprises at least one hook configured to be retainably received in one of the slots of the track members.

3. A cluster bin system as in claim 1, wherein the four regions of the planar member are each a parallelogram.

4. A cluster bin system as in claim 1, wherein the second and third regions of the planar member are trapezoids.

5. A cluster bin system as in claim 4, wherein the first region is also a trapezoid.

6. A cluster bin system as in claim 1, wherein said second and third regions each include a notch therein distal the base thereof.

7. A cluster bin system as in claim 6 including a plurality of planar members and wherein said notches are configured so as to permit the planar members to be folded into bins and to be affixed to the wall in a nested relationship.

8. A cluster bin system as in claim 1, wherein said planar member is fabricated from a material selected from the group consisting essentially of: synthetic polymeric materials, metals, cardboard, and combinations thereof.

9. A cluster bin system as in claim 1, wherein said planar member is fabricated from polypropylene.

10. A cluster bin system as in claim 1, wherein said planar member is fabricated from polyethylene.

11. A cluster bin system as in claim 1, further including a reinforcing member configured to be retained by, and reinforce the corner of, the bin.

12. A cluster bin system as in claim 1, wherein said planar member is fabricated from a sheet of material of a relatively uniform thickness and wherein the living hinges are provided by regions of the material having a lesser thickness.

* * * * *

UNITED STATES PATENT AND TRADEMARK OFFICE

CERTIFICATE OF CORRECTION

PATENT NO. : 4,955,488

DATED : September 11, 1990

INVENTOR(S) : James D. Nicoll

It is certified that error appears in the above-identified patent and that said Letters Patent is hereby corrected as shown below:

Column 6, Line 11, please delete "hinge" and insert -- living hinge --.

Column 6, Line 12, please delete "fur" and insert -- four --.

Signed and Sealed this

Seventeenth Day of March, 1992

*Attest:*

HARRY F. MANBECK, JR.

*Attesting Officer*

*Commissioner of Patents and Trademarks*